US006525277B2

(12) United States Patent
Oba et al.

(10) Patent No.: US 6,525,277 B2
(45) Date of Patent: Feb. 25, 2003

(54) MULTIPLE OPERATION TYPE INPUT DEVICE

(75) Inventors: Katsuichi Oba, Miyagi-ken (JP); Sachiko Homma, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/878,001

(22) Filed: Jun. 8, 2001

(65) Prior Publication Data

US 2002/0056611 A1 May 16, 2002

(30) Foreign Application Priority Data

Jun. 12, 2000 (JP) ..... 2000-176016

(51) Int. Cl.[7] ..... H01H 9/00
(52) U.S. Cl. ..... 200/4
(58) Field of Search ..... 200/1 R, 1 B, 200/4, 5 R, 6 A, 11 R, 17 R, 18, 341, 336

(56) References Cited

U.S. PATENT DOCUMENTS 5,877,463 A * 3/1999 Choi ..... 200/4
6,049,044 A 4/2000 Mizobuchi ..... 200/4
6,271,488 B1 * 8/2001 Sasaki ..... 200/4

FOREIGN PATENT DOCUMENTS

JP 10-177826 6/1998 ..... 13/64

* cited by examiner

*Primary Examiner*—Michael Friedhofer
(74) *Attorney, Agent, or Firm*—Beyer Weaver & Thomas, LLP

(57) ABSTRACT

There is provided a multiple operation type input device that can perform self-returning rotating operation and two-stage push operation, and can be applied to a digital camera with a zoom function. A multiple operation type input device is provided with a rotary electrical part driven rotatably via a operation body, and a push switch arranged in an opening at the center portion of the operation body and driven by push via a key top, wherein the push switch has a first push switch element and a second push switch element having different actuation forces and stacked along the push operation direction of the key top. This provides the multiple operation type input device of compact size, which can perform rotating operation and two-stage push operation. Further, fixed contacts for engaging and disengaging click springs of the first and second push switch elements and a sliding pattern to be contacted slidably with a slider of the rotary electrical part are formed on a common flexible substrate.

12 Claims, 8 Drawing Sheets

MULTIPLE OPERATION TYPE INPUT DEVICE

BACKGROUND OF THE INVENTION

1. Field of the Invention

The present invention relates to a multiple operation type input device capable of performing rotating operation and pushing operation, more specifically, to a multiple operation type input device suitable for use in a digital camera and the like.

2. Description of the Prior Art

In recent years, there has been widespread use of a multiple operation type input device that includes a key top arranged at the center portion of a rotatable knob (an operation body), in which, when the knob is operated rotatably, an output signal such as a resistance value can be changed, and when the key top is pushed, a push switch can be switched ON or OFF. A conventional input device of this kind is generally constructed so that the push switch is driven by pushing via the key top provided in the rotary electrical part. The rotary electrical part incorporates a slider, rotated integrally with the knob that is slidably contacted with a sliding pattern. The push switch incorporates a push switch element with a click mechanism having a movable contact and a fixed contact disposed opposite to each other. It is expected that a multiple operation type input device of compact size that can selectively perform two kinds of input operations including the rotating operation of the knob and the push operation of the key top, can be applied to various electronic devices.

The above-mentioned conventional multiple operation type input device can selectively perform two kinds of input operations including the rotating operation and the push operation. However, in the case of, for example, a digital camera with a zoom function, there is required an input device that can manage zooming with the rotating operation, and focusing and shutter operations with a two-stage push operation. The conventional multiple operation type input device cannot be applied to such an electronic device.

SUMMARY OF THE INVENTION

The present invention has been made in view of the circumstances of the prior art, and an object of the present invention is to provide a multiple operation type input device of compact size that can perform a rotating operation and a two-stage push operation and can be applied to a digital camera with a zoom function.

To achieve the foregoing object, a multiple operation type input device of the present invention comprises a rotatable operation body having an opening and self-returned to a predetermined position, a rotary electrical part driven rotatably via the operation body, a key top arranged in the opening and operated by pushing in the rotating axial direction of the operation body, and a push switch arranged at the center portion of the rotary electrical part and driven by pushing via the key top, wherein the push switch has a first push switch element and a second push switch element having different actuation forces and stacked along the push operation direction of the key top.

In the input device thus constructed, when the key top is pushed in, one of the push switch elements having a small actuating force is first switched from off to on and, when the key top is further pushed in, the other push switch element having a large actuating force is switched from OFF to ON, The input device can thus perform two-stage push operation. In addition, the operation body is rotated to change the output signal of the rotary electrical part, and upon the removal of the rotating operation force can self-return the operation body to a predetermined position. Preferably, a spring member deformed elastically with the rotation of the operation body is incorporated into the rotary electrical part, as a self-returning mechanism for self-returning the operation body.

In such a construction, preferably, the fixed contacts of the first and second push switch elements are formed on a flexible substrate and are arranged on the side of the flexible substrate nearest the key top. In particular, in a typical construction the rotary electrical part has a sliding pattern to be contacted slidably with a slider rotated integrally with the operation body. The sliding pattern and the fixed contacts of the first and second push switch elements are all formed on the common flexible substrate. It is possible to provide the multiple operation type input device that can reduce the number of parts and have good assembling properties.

In such a construction, the push switch has a driving body interposed between the first push switch element and the second push switch element for driving the second push switch element by pushing the first push switch element, guide means for guiding the movement of the driving body along the push operation direction of the key top, and click means for allowing the first and second push switch elements to each cause a click feeling at input. Since the driving body can be smoothly slide along the push operation direction of the key top, a push driving mechanism such as a hinge mechanism, which tends to be too large, is not employed, thereby easily making the device small. In this case, the guide means is provided with a plurality of guide protrusions, extending in the push operation direction of the key top, arranged so as to surround the push switch and being formed integrally with a support member for mounting the first and second push switch elements. The plurality of the guide protrusions slides the driving body more smoothly and is suitable for making the device of the present invention small.

The multiple operation type input device further comprises a guide body having the guide protrusions, a frame-like portion for coupling the base ends of the guide protrusions, and a plurality of mounting protrusions extending from the frame-like portion in the direction opposite to the guide protrusions. The mounting protrusions are mounted on the support member while the flexible substrate is held between the frame-like portion and the support member. Preferably, the flexible substrate can be prevented from being isolated from the support member. Further, each guide protrusion is formed in an elastically deformable pole shape. At its free end, the guide protrusion is provided with a nail portion capable of retaining the driving body. Preferably, the construction of the present invention must not be complicated, the driving body can be prevented from coming off, and the height position during non-operation can be defined, whereby assembling properties can be improved.

In a typical construction, the rotary electrical part has a sliding pattern to be contacted slidably with the slider rotated integrally with the operation body. The sliding pattern and the fixed contacts of the first and second push switch elements are all formed on the same surface of the flexible substrate, and the flexible substrate is bent in an S shape and is mounted on the driving body, so that the fixed contact forming region of the push switch element is arranged at the side near the key top. Preferably, it is possible to use the flexible substrate having the conductive pattern formed only on a single side, which is inexpensive and can easily be incorporated within the present invention. In this case, a pair of retaining portions is provided on the driving body, and a pair of retained portions is provided on the flexible substrate so as to be retained to the pair of retaining portions, respectively. Thus, the flexible substrate can easily be mounted on the driving body without using a double-sided adhesive sheet or the like thereby improving the assembling properties of the present invention.

DESCRIPTION OF THE PREFERRED EMBODIMENTS

Figure 1:
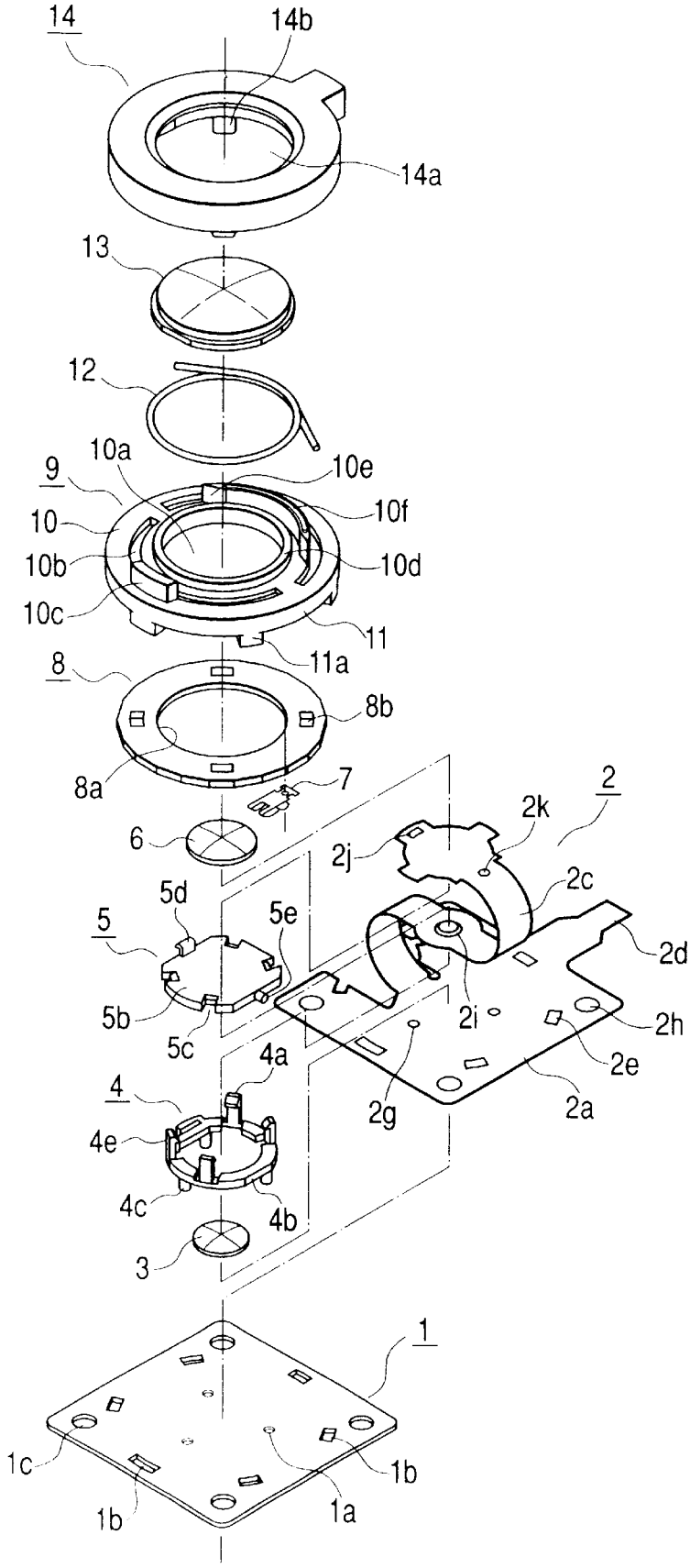
FIG. 1 is an exploded perspective view of a multiple operation type input device according to one embodiment of the present invention.
Figure 2:
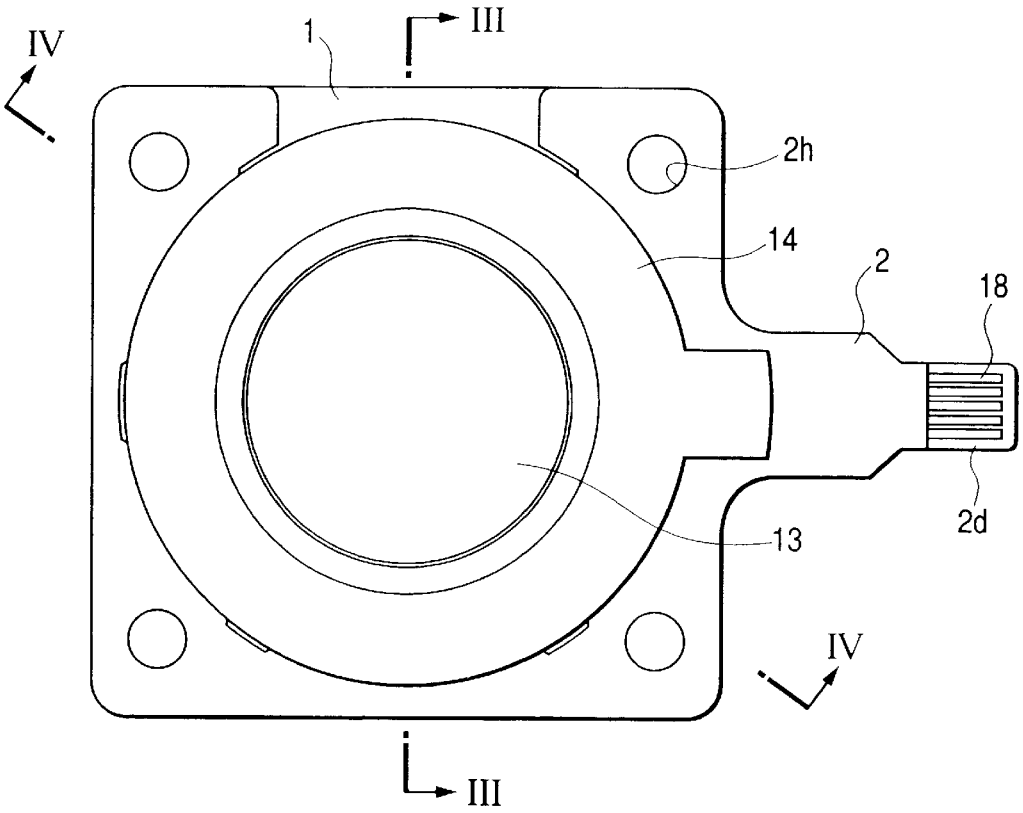
FIG. 2 is a plan view of the input device.
Figure 3:
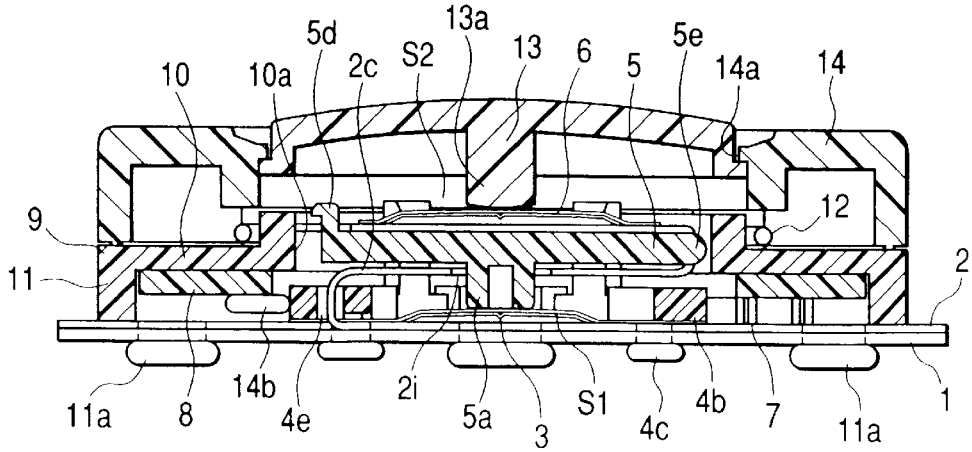
FIG. 3 is a cross-sectional view taken along line III—III of FIG. 2.
Figure 4:
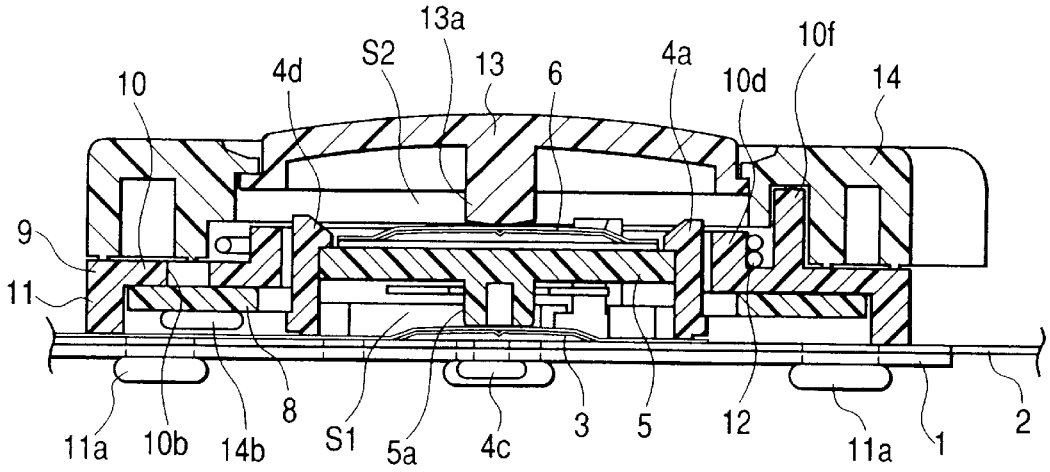
FIG. 4 is a cross-sectional view taken along line IV—IV of FIG. 2.
Figure 5:
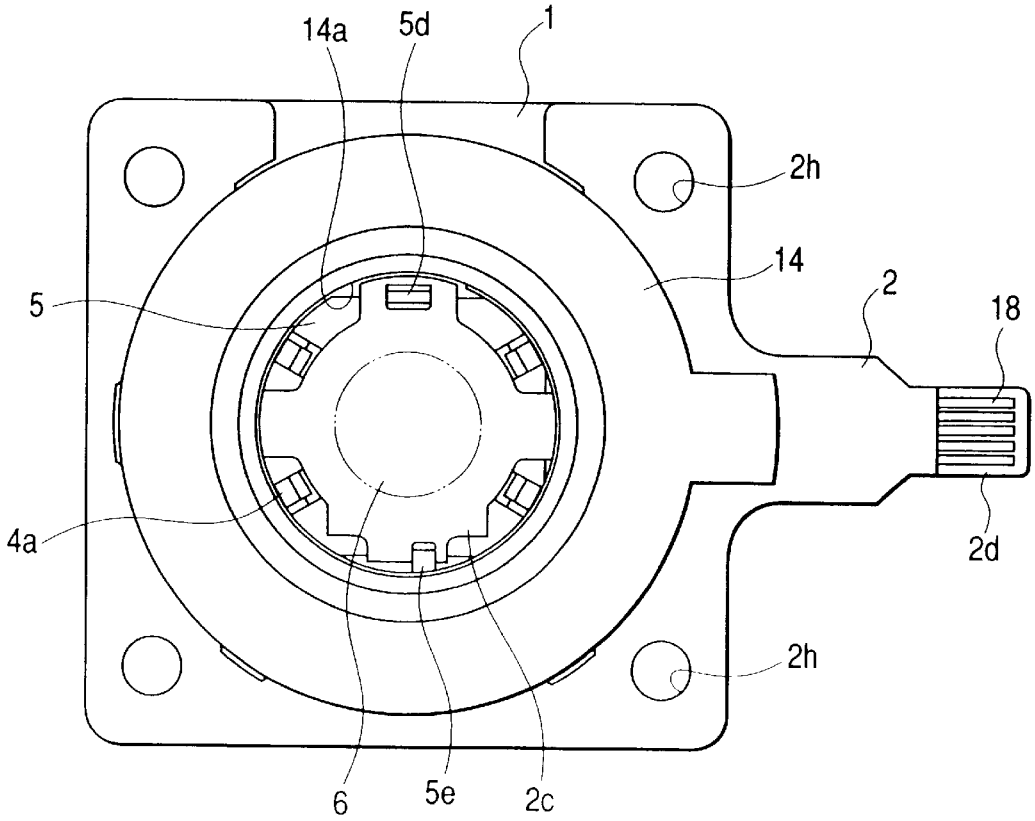
FIG. 5 is a plan view of the input device with the key top omitted.
Figure 6:
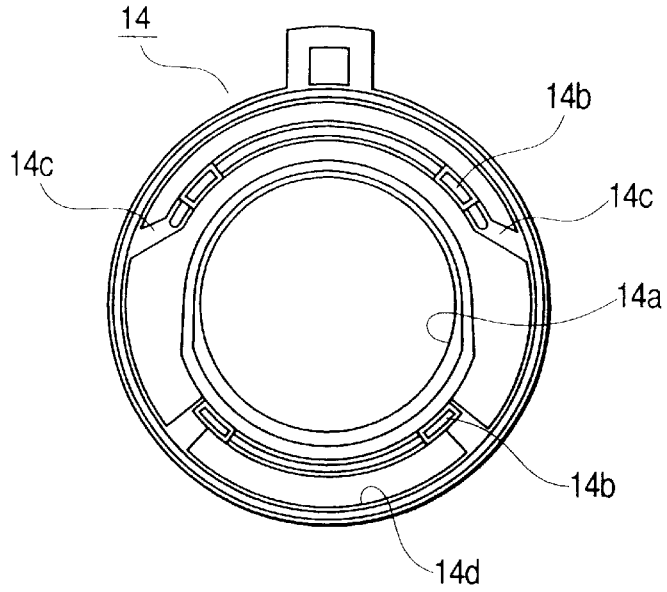
FIG. 6 is a bottom view of the operation body of the input device.
Figure 7:
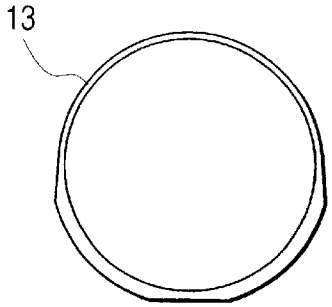
FIG. 7 is a plan view of the key top of the input device.
Figure 8:
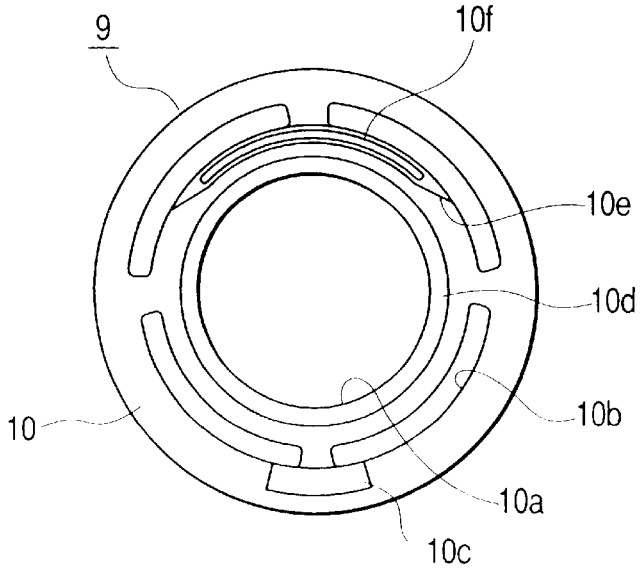
FIG. 8 is a plan view of the container of the input device.
Figure 9:
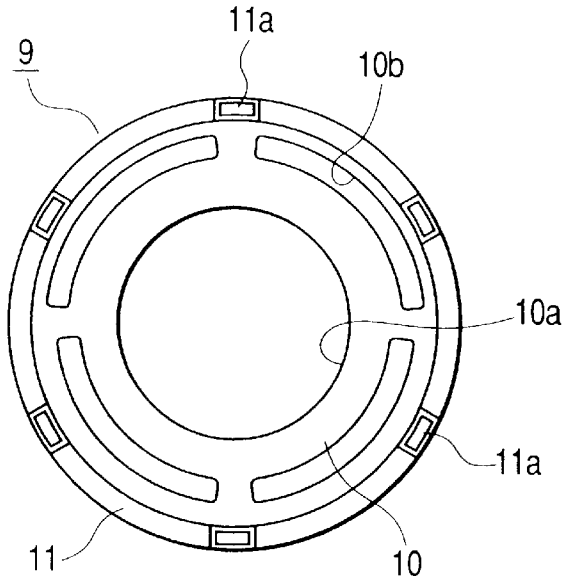
FIG. 9 is a bottom view of the container.
Figure 10:
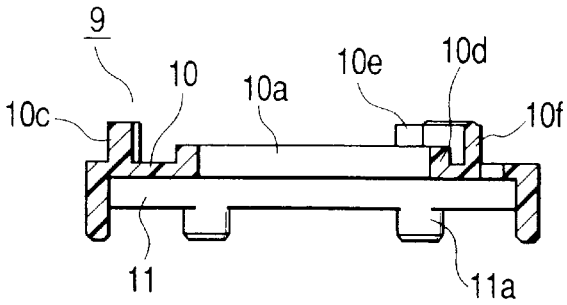
FIG. 10 is a cross-sectional view of the container.
Figure 11:
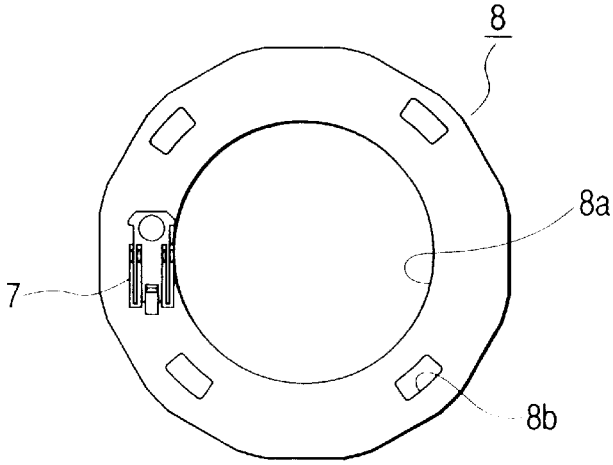
FIG. 11 is a bottom view of the slider receiver with the slider of the input device.
Figure 12:
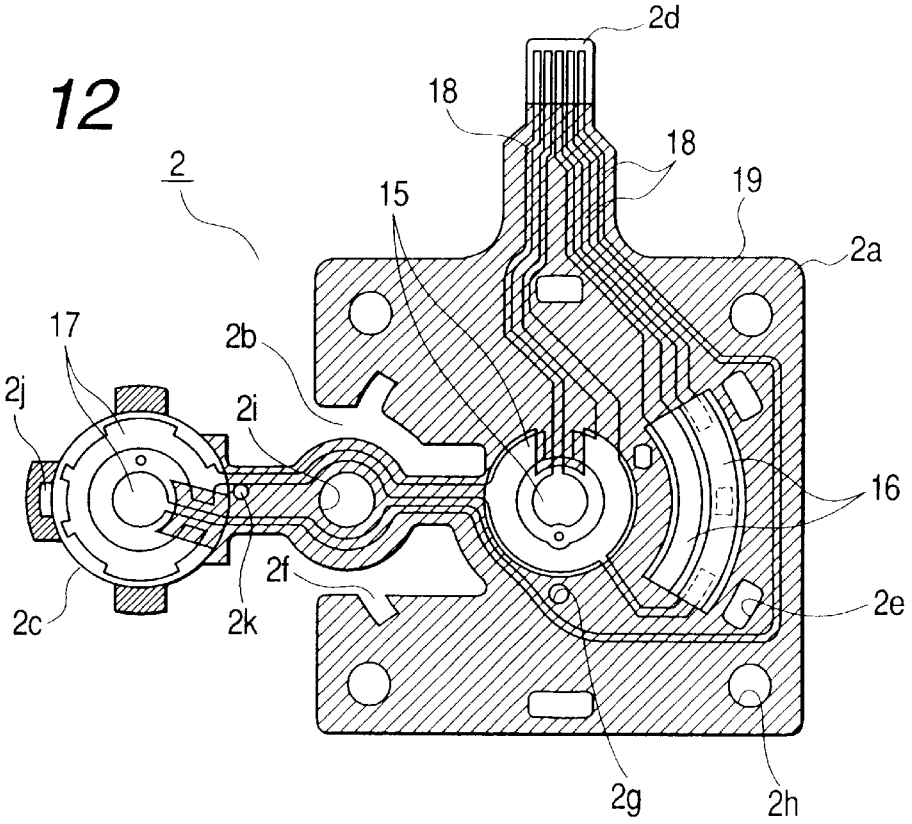
FIG. 12 is a development of the flexible substrate of the input device.
Figure 13:
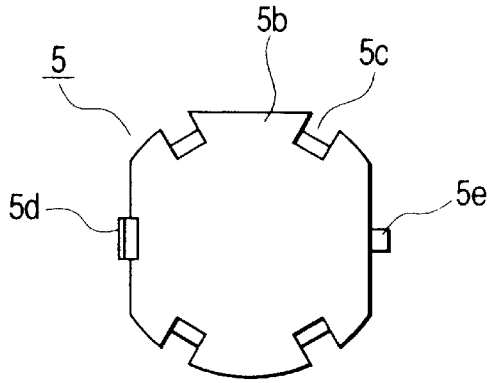
FIG. 13 is a plan view of the driving body of the input device.
Figure 14:
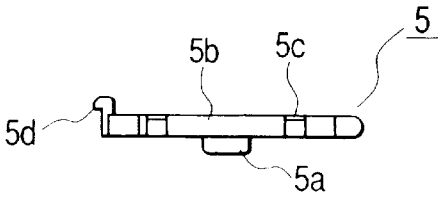
FIG. 14 is a side view of the driving body.
Figure 15:
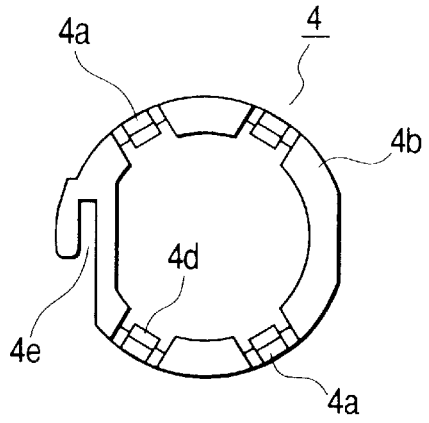
FIG. 15 is a plan view of the guide body of the input device.
Figure 16:
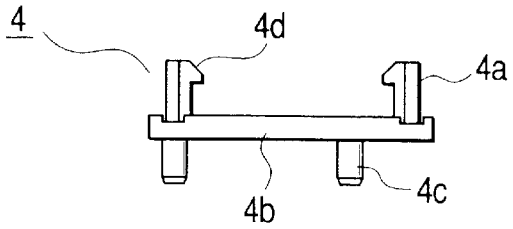
FIG. 16 is a side view of the guide body.
Figure 17:
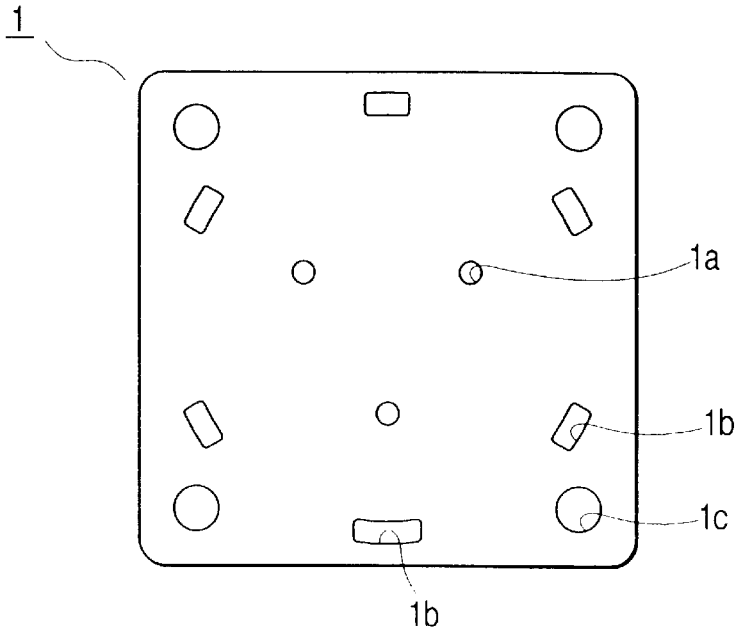
FIG. 17 is a plan view of the support plate of the input device.
Figure 18:
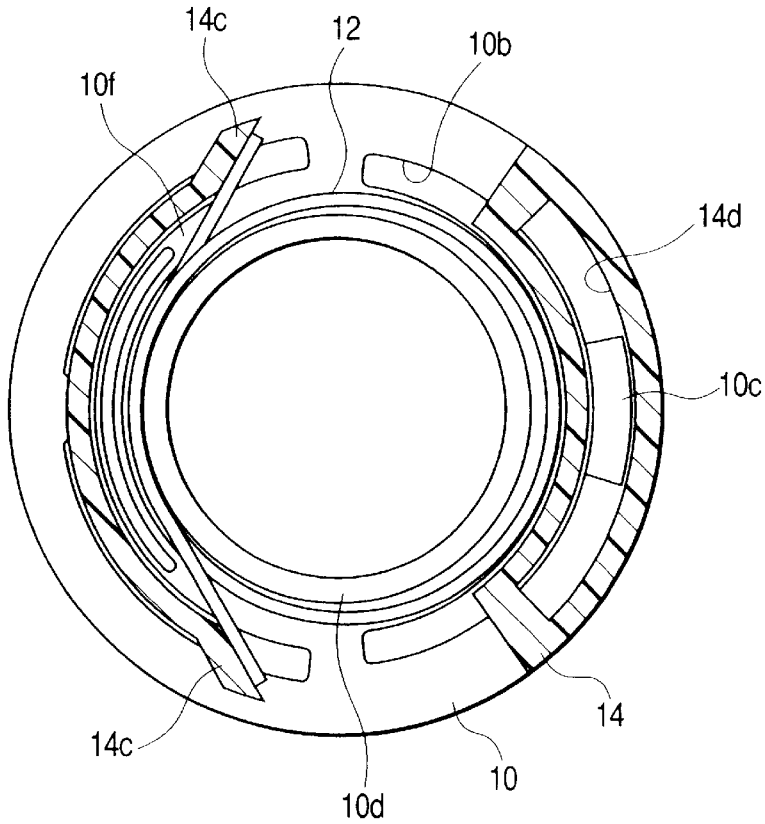
FIG. 18 is an explanatory view showing the self-returning mechanism and the stopper mechanism of the input device when the device is not operated.
Figure 19:
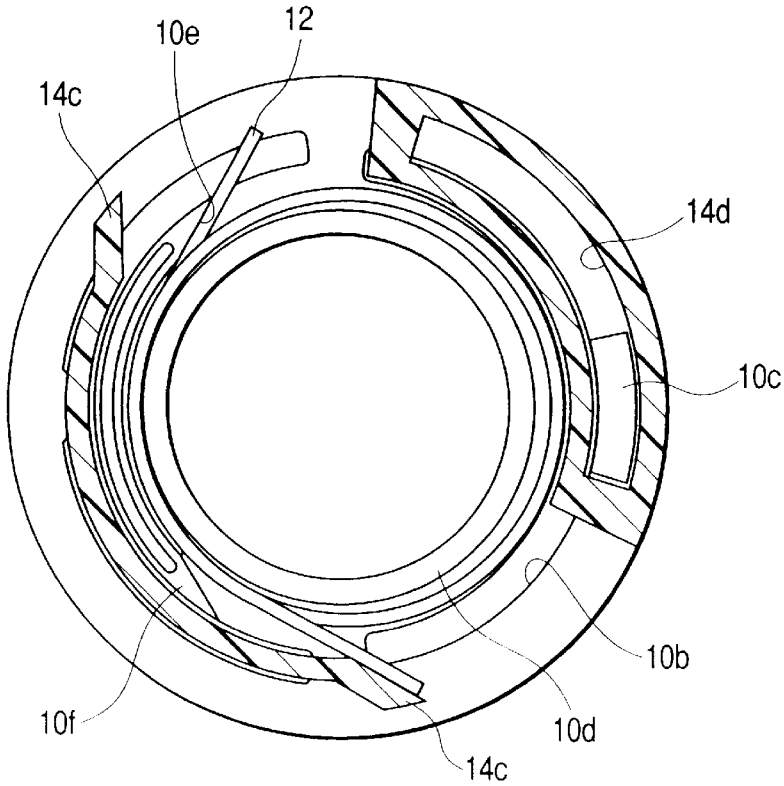
FIG. 19 is an explanatory view corresponding to FIG. 18 when the device is operated rotatably.

Embodiments will be described with reference to the drawings. FIG. 1 is an exploded perspective view of a multiple operation type input device according to one embodiment of the present invention. FIG. 2 is a plan view of the input device. FIG. 3 is a cross-sectional view taken along line III—III of FIG. 2. FIG. 4 is a cross-sectional view taken along line IV—IV of FIG. 2. FIG. 5 is a plan view of the input device with the key top omitted. FIG. 6 is a bottom view of the operation body of the input device. FIG. 7 is a plan view of the key top of the input device. FIG. 8 is a plan view of the container of the input device. FIG. 9 is a bottom view of the container. FIG. 10 is a cross-sectional view of the container. FIG. 11 is a bottom view of the slider receiver with the slider of the input device. FIG. 12 is a development of the flexible substrate of the input device. FIG. 13 is a plan view of the driving body of the input device. FIG. 14 is a side view of the driving body. FIG. 15 is a plan view of the guide body of the input device. FIG. 16 is a side view of the guide body. FIG. 17 is a plan view of the support plate of the input device. FIG. 18 is an explanatory view showing the self-returning mechanism and the stopper mechanism of the input device when the device is not operated. And FIG. 19 is an explanatory view corresponding to FIG. 18 when the device is operated rotatably.

The multiple operation type input device showing its overall construction in FIGS. 1 to 5 is a device applicable to a digital camera with a zoom function. The input device chiefly includes a support plate 1 made of a metal plate, a flexible substrate 2 having a conductive pattern formed on an insulating base material such as polyester film, a first click spring 3 in a dome shape serving as a first movable contact, a guide body 4 of synthetic resin having a plurality of guide protrusions 4*a*, a driving body 5 of synthetic resin having a driving body push protrusion 5*a* capable of being moved upward or downward guided by the guide protrusions 4*a*, a second click spring 6 in a dome shape serving as a second movable contact, a metal slider 7, a slider receiver 8 of synthetic resin provided with the slider 7, a container 9 of synthetic resin having a ceiling portion 10 and a tube portion 11, a torsion spring 12 for self-returning, a key top 13 of synthetic resin, and a operation body 14 of synthetic resin coupled integrally with the slider receiver 8.

As shown in FIGS. 1 and 17, the support plate 1 is provided with three small holes 1*a* for mounting the guide body 4, six square holes 1*b* arranged for mounting the container 9 so as to surround the small holes 1*a*, and round holes 1*c* arranged in four corners for mounting the support plate 1 itself on an external mechanism, not shown.

As shown in FIG. 12, the flexible substrate 2 includes a rectangular base portion 2*a*, a belt-like portion 2*c* extending from a notch 2*b* provided in one side of the base portion 2*a*, and a belt-like leads portion 2*d* extending from one side of the base portion 2*a* in the direction normal to the belt-like portion 2*c*. The base portion 2*a* is provided with four long holes 2*e* and two notches 2*f* are arranged in a circular arc segment shape, two small holes 2*g* arranged inwardly from the long holes 2*e*, and mounting holes 2*h* positioned in four corners. The belt-like portion 2*c* is provided with a round hole 2*i* for inserting the driving body push protrusion 5*a* of the driving body 5, and a pair of retaining holes 2*j*, 2*k* for retaining the driving body 5. On the top surface of the flexible substrate 2, the base portion 2*a* is provided thereon with a pair of first fixed contacts 15 and a circular arc sliding pattern 16, the front end of the belt-like portion 2*c* is provided thereon with a pair of second fixed contacts 17, and there are formed a routing lines 18 for routing the fixed contacts 15, 17 or the sliding pattern 16 onto the leads portion 2*d*. These conductive patterns are formed by printing a conductive paste such as silver or carbon. The sliding pattern 16 is provided with a substantially belt-like (circular arc) resistance pattern (outside pattern) and collecting pattern (inside pattern). These conductive patterns, except for the first and second fixed contacts 15,17, the sliding pattern 16, and the portion of the routing lines 18 positioned in the front end of the leads portion 2*d*, are also over-coated with an insulating resist layer 19 as indicated by the hatched area of FIG. 12.

The base portion 2*a* of the flexible substrate 2 is mounted on the support plate 1, while the mounting holes 2*h* are matched with the round holes 1*c*, and the long holes 2*e* and the notches 2*f* are matched with the square holes 1*b*. The belt-like portion 2*c* of the flexible substrate 2 is incorporated while being bent in an S shape, as shown in FIGS. 1 and 3.

The dome shaped first click spring 3, serving as the first movable contact, is formed of a stainless leaf spring, for example, with a plate thickness of 0.07 mm and a diameter of 5 mm. The click spring 3 is mounted on the first fixed contact 15 forming region of the base portion 2*a* of the flexible substrate 2, so as to contact the ring-like outside fixed contact 15 all the time, and to be disposed opposite to the circular inside fixed contact 15 to engage and disengage the same. The click spring 3 is adhesively fixed onto the flexible substrate 2 with an insulating sheet covering, not shown, adhesively coated on one side. The first click spring 3 and the first fixed contact 15 comprise a first push switch element S1. A relatively large push operation force is applied to the click spring 3 so as to bring the deflected center portion of the click spring 3 into contact with the circular fixed contact 15 opposite thereto, whereby the inside and outside fixed contacts 15 can be rendered electrically conductive.

The dome shaped second click spring 6, serving as the first movable contact, is also formed of a stainless leaf spring, for example, with a plate thickness of 0.05 mm and a diameter of 6 mm. The center portion of the second click spring 6 can thus be actuated by a push operation with a force smaller than that applied to the first click spring 3. The second click spring 6 is mounted on the second fixed contact 17 forming region of the belt-like portion 2*c* of the flexible substrate 2, so as to contact the ring-like outside fixed contact 17 all the time, and to be disposed opposite to the circular inside fixed contact 17 to engage and disengage the same. Similar to the first click spring 3, the click spring 6 is also adhesively fixed onto the flexible substrate 2 with an insulating sheet covering, not shown, adhesively coated on one side. The second click spring 6 and the second fixed contact 17 comprise a second push switch element S2. A relatively small push operation force is applied to the click spring 6 so as to bring the deflected center portion of the click spring 6 into contact with the circular fixed contact 17 opposite thereto, whereby the inside and outside fixed contacts 17 can be rendered electrically conductive.

As shown in FIGS. 1, 15 and 16, the guide body 4 includes four pole-like guide protrusions 4*a* that can be deformed elastically, a frame-like portion 4*b* for coupling the base ends of the respective guide protrusions 4*a*, and three mounting protrusions 4*c* extending from the frame-like portion 4*b* in the direction opposite to the guide protrusions 4*a*. The free end of each of the guide protrusions 4*a* is provided with a nail portion 4*d* protruding inwardly. The frame-like portion 4*b* is provided with an engaging groove 4*e* by protruding a part of the same outwardly in an L shape.

The guide body 4 is fixed onto the support plate 1 in the following manner. Each of the mounting protrusions 4*c* is inserted into the small hole 2*g* and the notch 2*b* of the flexible substrate 2 and the small hole 1*a* of the support plate 1, the frame-like portion 4*b* is placed on the base portion 2*a* of the flexible substrate 2, and the front end of the respective mounting protrusions 4*c* is caulked thermally to the bottom surface of the support plate 1. The first push switch element S1 is arranged in the inside space of frame-like portion 4*b*. Since the base portion 2*a* of the flexible substrate 2 is held between the frame-like portion 4*b* and the support plate 1, the push switch element S1 is confined between the guide body 4 and the support plate 1.

As shown in FIGS. 1, 13 and 14, the driving body 5 includes a driving body push protrusion 5*a*, projecting downward from the center of a flat plate-like portion 5*b*, for pushing the first click spring 3 in, driving body push protrusion 5*a*, engaging notches 5*c* formed in four positions along the outer perimeter of the flat plate-like portion 5*b* into which the guide protrusions 4*a* are inserted loosely, an L-shaped hook 5*d* protruding sidewise from the flat plate-like portion 5*b*, and a small post 5*e* opposite to the hook 5*d* protruding sidewise from the flat plate-like portion 5*d*.

The driving body 5 is placed on the flat plate-like portion 5*b* in the following manner. A pair of retaining holes 2*j*, 2*k* provided on the belt-like portion 2*c* of the flexible substrate 2 are retained to the hook 5*d* and the small post 5*e*, respectively, whereby the second fixed contact 17 forming region of the belt-like portion 2*c* cannot be loosened. The second push switch element S2 is thus coupled with the flat plate-like portion 5*b*. As shown in FIG. 3, the driving body push protrusion 5*a* of the driving body 5 is inserted into the round hole 2*i* of the belt-like portion 2*c* bent in an S shape, and then the folded portion of the belt-like portion 2*c* at the side closer to the base portion 2*a* than the round hole 2*i* is inserted into the engaging groove 4*e* of the guide body 4. The engaging notch 5*c* of the driving body 5 retaining the belt-like portion 2*c* is aligned with the guide protrusion 4*a* of the guide body 4. In this state, when the flat plate-like portion 5*b* is pushed in while the guide protrusions 4*a* are deflected outwardly, the deflection of the guide protrusions 4*a* is released. At this stage, the driving body 5 is incorporated into the inside of the guide body 4 so as to be moved upward or downward, and then the driving body push protrusion 5*a* is placed on the first click spring 3. The up-and-down movement of the driving body 5 can be smoothly done by guiding of the guide protrusion 4*a* in the engaging notch 5*c*. The nail portion 4*d* on the free end of each of the guide protrusions 4*a* can prevent the driving body 5 from coming off upwardly, and the height position of the driving body 5 can be defined during non-operation.

As shown in FIGS. 1 and 11, the slider receiver 8 is a flat plate ring body having a polygonal outer perimeter shape, having an opening 8*a* in its center portion, and having coupling holes 8*b* formed in four positions spaced at equal intervals. The slider receiver 8 is provided in its bottom surface with the slider 7. The slider 7 is contacted slidably with the sliding pattern 16 on the base portion 2*a* of the flexible substrate 2.

As shown in FIG. 1 and FIGS. 8 to 10, the container 9 includes the ceiling portion 10 having in its center portion an opening 10*a* and circular-arc long holes 10*b* in four positions, a stopper protrusion 10*c* disposed vertically on the ceiling portion 10, the tube portion 11 disposed vertically downwardly from the outer circumference portion of the ceiling portion 10, and mounting protrusions 11*a* at equal intervals provided in six positions of the bottom surface of the tube portion 11. On the ceiling portion 10, there are provided a vertical ring-like wall 10*d* for regulating the position of the torsion spring 12 from the inside thereof and a spring receiving portion 10*f* having taper surfaces 10*e* for contacting and stopping the ends of the torsion spring 12, the torsion spring 12 being placed between the ring-like wall 10*d* and the spring receiving portion 10*f*.

As shown in FIGS. 3 and 4, in the opening 10*a* of the container 9, there are arranged the driving body 5, having the second push switch element S2 mounted thereon, and the guide protrusion 4*a* of the guide body 4. In the inside of the tube portion 11 of the container 9, there is arranged the slider receiver 8 adjacent the bottom side of the ceiling portion 10. The outer perimeter surface of the slider receiver 8 is contacted slidably with the inner circumference surface of the tube portion 11. Four coupling protrusions 14*b* of the operation body 14, arranged on the ceiling portion 10 of the container 9, are inserted into the four long holes 10*b*, respectively, and are further inserted into the coupling holes 8*b* of the slider receiver 8. The front end of the respective coupling protrusions 14*b* is caulked thermally to the bottom surface of the slider receiver 8. The operation body 14 is thus formed integrally with the slider receiver 8. The rotating operation of the operation body 14 is guided by the inner circumference surface of the tube portion 11 functioning as a bearing surface to the outer circumference surface of the slider receiver 8.

As shown in FIGS. 1, 2, 5 and 6, the operation body 14 has in its center portion an opening 14*a* for arranging the key top 13. Coupling protrusions 14*b* are provided in four positions at equal intervals in the bottom surface of the operation body 14. The coupling protrusions 14*b* can couple the operation body 14 integrally with the slider receiver 8. The bottom surface of the operation body 14 is also provided with a spring push wall portion 14*c* for pushing the end of the torsion spring 12, interposed between the operation body 14 and the ceiling portion 10 of the container 9 and a stopper moving path 14*d*, and regulating its rotational amount by movably inserting the stopper protrusion 10*c* on the ceiling portion 10. While the key top 13 is not rotated by the operation body 14, the key top push protrusion 13*a* provided in the center of the inner bottom surface is mounted on the second click spring 6. The inner wall portion of the operation body 14 guides the up-and-down movement of the key top 13, as shown in FIGS. 3 and 4.

The operation of the multiple operation type input device thus constructed will be described. First, the operation of the push switch driven by push via the key top 13 will be described. Then, the operation of the rotary electrical part driven rotatably via the operation body 14 will be described.

Now, an operator pushes the key top 13 in using a finger. When the key top 13 is pushed in by a predetermined amount, the key top push protrusion 13*a* of the key top 13 reversibly operates the second click spring 6 having a small actuation force, so that the second push switch element S2 is switched from OFF to ON. When the key top 13 is further pushed in, the driving body 5 is lowered while the second push switch element S2 is held ON. The driving body push protrusion 5*a* of the driving body 5 reversedly operates the first click spring 3 having a large actuation force, so that the first push switch element S1 is switched from OFF to ON. When the operator lightly pushes the key top 13 in and feels a click, the operator can realize that the second push switch element S2 is turned on. When the operator strongly pushes the key top 13 in and feels a click, the operator can realize that the first push switch element S1 is turned on. Specifically, in this embodiment, when the second push switch element S2 is turned on, the digital camera can be focused, and when the first push switch element S1 is turned on, shutter operation can be adjusted.

When the operator rotates the operation body 14, the slider 7 is rotated integrally therewith and slides on the sliding pattern (resistance pattern and collecting pattern) 16, thereby providing a resistance value according to the position of the slider 7. In other words, different resistance values according to the rotational amount of the operation body 14 can beprovided. In this embodiment, the rotating operation of the operation body 14 permits zooming of a digital camera.

The self-returning mechanism of the operation body 14 will be described. As shown in FIG. 18, when the operation body 14 is not operated rotatably, a pair of spring push wall portions 14*c* and a pair of the taper surfaces 10*e* of the spring receiving portion 10*f* are contacted elastically with both ends of the torsion spring 12. As shown in FIG. 19, when the operation body 14 is rotated, one of the spring push wall portions 14*c* is moved away from one of the ends of the torsion spring 12, and then, while this end is hits and is stopped by the taper surface 10*e* of the spring receiving portion 10*f* of the container 9, the other end thereof is deflected by the pushing motion against the other spring push wall portion 14*c*. When the rotation operating force to the operation body 14 is removed, the end of the torsion spring 12 deflected by this pushing motion returns the spring push wall portion 14*c*, so that the operation body 14 is self-returned to a predetermined position shown in FIG. 18. When the operator removes the finger from the operation body 14, the zoom scaling is returned automatically to the original state. Further, when the operation body 14 is rotated, the stopper protrusion 10*c* of the container 9 is moved along the stopper moving path 14*d*. Then, when the operation body 14 is rotated by a predetermined amount, the stopper protrusion 10*c* comes into contact with the end surface of the stopper moving path 14*d*, as shown in FIG. 19, thereby precluding further rotation of the operation body 14. In the case where an excessive rotation operating force is applied to the operation body 14, the coupling protrusion 14*b* can be prevented from being damaged by hitting the end surface of the long hole 10*b* of the container 9.

In this embodiment as described above, when the key top 13 is pushed in, one of the push switch element S2 having a small actuation force is switched OFF to ON. When the key top 13 is further pushed in, the other push switch element S1 having a large actuation force is switched from OFF to ON. Thus, two-stage push operation can be accomplished. When the operation body 14 is rotated, the output signal of the rotary electrical part can be changed appropriately, whereby the operation body 14 can also be self-returned to a predetermined position by the self-returning mechanism. When the multiple operation type input device is applied to a digital camera, focusing and shutter operations suitable for two-stage push operation are performed by the first and second push switch elements S1 and S2. Zooming suitable for rotating operation is done by the operation body 14 so as to improve operativity and make the device small. In this embodiment, during push operation, the second click spring 6 near the key top 13 is first operated reversedly, and then the first click spring 3 at the lower side is operated reversedly. However, the click spring having a small actuation force operated reversedly ahead of the first click spring 3 may be disposed at the lower side.

In the multiple operation type input device described above, the first and second push switch elements S1, S2 and the sliding pattern 16 of the rotary electrical part are all formed on the same plane of the common flexible substrate 2. In addition, the flexible substrate 2 is bent in an S shape, and the fixed contact forming region of the second push switch element S2 at the upper side is mounted on the driving body 5. It is possible to use the flexible substrate 2 having the conductive pattern inexpensively formed only on its top surface side, which is inexpensive and can easily be incorporated within the present invention. The flexible substrate 2 can be mounted on the flat plate-like portion 5*b* in such a manner that a pair of the retaining holes 2*j*, 2*k* are retained to the hook 5*d* and the small post 5*e*, respectively, of the driving body 5, whereby the fixed contact forming region of the belt-like portion 2*c* cannot be loosened. The flexible substrate 2 can be easily mounted on the driving body 5 without using a double-sided adhesive sheet.

The present invention is embodied by the embodiments described above, and has the effects described below.

The multiple operation type input device is provided with a rotary electrical part driven rotatably via a operation body, and a push switch arranged in the opening of the operation body and driven by push via a key top, wherein the push switch has a first push switch element and a second push switch element having different actuation forces and stacked along the push operation direction of the key top. The multiple operation type input device can perform rotating operation and two-stage push operation, can be easily made small, and can be applied to a digital camera with a zoom function.

The fixed contacts of the first and second push switch elements and the sliding pattern of the rotary electrical part are all formed on the common flexible substrate. The number of parts comprising the present invention can be reduced, and its assembling properties can easily be improved. In this case, the fixed contacts and the sliding pattern are formed on the same surface plane of the flexible substrate, the flexible substrate is bent in an S shape, and the driving body for driving by push one of the push switch elements has mounted thereon the fixed contact forming region of the other push switch element. It is possible to use the flexible substrate having the conductive pattern formed only on its single side, which is inexpensive and can easily be incorporated.

What is claimed is:

1. A multiple operation type input device comprising:

a rotatable operation body having an opening and self-returned to a predetermined position;

a rotary electrical part driven rotatably via the operation body;

a key top arranged in the opening and operated by pushing in a direction of an axis of rotation of the operation body; and a push switch arranged at a center portion of the rotary electrical part and driven by pushing via the key top, wherein the push switch includes a first push switch element and a second push switch element having different actuation forces and stacked along the push operation direction of the key top, and wherein a fixed contact of each of the first and second push switch elements of the push switch is formed on a flexible substrate and is arranged at a surface of the flexible substrate nearest the key top.

2. The multiple operation type input device according to claim 1, wherein the rotary electrical part has a sliding pattern contacted slidably with a slider rotated integrally with the operation body, and wherein the sliding pattern is also formed on the flexible substrate.

3. The multiple operation type input device according to claim 1, wherein the push switch has a driving body interposed between the first push switch element and the second push switch element for driving by pushing one of the push switch elements, a guide means for guiding the movement of the driving body along the push operation direction of the key top, and click means for allowing the first and second push switch elements to cause a click feeling at input, respectively.

4. The multiple operation type input device according to claim 3, wherein the guide means is formed integrally with a support member for mounting the first and second push switch elements, the support member having a plurality of guide protrusions extending in the push operation direction of the key top arranged so as to surround the push switch.

5. The multiple operation type input device according to claim 4, further comprising a guide body having a plurality of the guide protrusions, a frame-like portion for coupling base ends of the guide protrusions, and a plurality of mounting protrusions extending from the frame-like portion in a direction opposite to the guide protrusions, wherein the mounting protrusions are mounted on the support member while the flexible substrate is held between the frame-like portion and the support member.

6. The multiple operation type input device according to claim 4, wherein the guide protrusions are in an elastically deformable pole shape, each of the guide protrusions being provided at its free end with a nail portion capable of retaining the driving body.

7. The multiple operation type input device according to claim 3, wherein the rotary electrical part has a sliding pattern contacted slidably with a slider rotated integrally with the operation body, the sliding pattern and the fixed contacts of the first and second push switch elements all being formed on a same surface plane of the flexible substrate, and wherein the flexible substrate is bent in an S shape and mounted on the driving body, so that a fixed contact forming region of the push switch element is arranged at a surface of the flexible substrate nearest the key top.

8. The multiple operation type input device according to claim 7, wherein a pair of retaining portions are provided on the driving body, and a pair of retained portions are provided on the flexible substrate so as to couple the pair of retaining portions provided on the driving body with the retaining portions provided on the flexible substrate.

9. The multiple operation type input device according to claim 1, wherein the rotary electrical part has a spring member deformed elastically with the rotation of the operation body.

10. A multi-function electric controller input device comprising:

a knob having a top with an opening in a central portion of the top and rotatable about an axis of rotation, along the knob and substantially normal to the top, upon application of a rotating operation force and self-returnable to a predetermined position upon removal of the rotating operation force;

a rheostat coupled with the knob for providing a variable electrical resistance corresponding to a position of the knob upon rotation;

a push button arranged within the opening in the central portion of the top and movable along the axis of rotation upon application of a pushing operation force in a direction of the axis of rotation;

a first push switch coupled to the push button for activation by the push button;

a second push switch stacked below the first push switch, the second push switch being coupled to the push button for actuation by the push button upon application of a second pushing operation force that is greater than a first pushing force required to actuate the first push switch, and wherein a fixed contact for each of the first and second push switches is formed on a flexible substrate and is arranged at the surface of the flexible substrate nearest the push button.

11. The multi-function electric controller input device according to claim 10, wherein the rheostat comprises an arc segment shaped, electrically resistive inner sliding pattern and an arc segment shaped, electrically resistive outer sliding pattern separated from the inner sliding pattern, both of the sliding patterns being formed on the flexible substrate, and a slider coupled to and rotated integrally with the knob, in slidable electric contact with and electrically bridging the inner and outer sliding patterns whereby the electrical resistance along the sliding patterns through the slider is varied corresponding to the position of the knob upon rotation.

12. A multi-function electric controller input device according to claim 10, wherein the push button has a driving body interposed between the first push switch and the second push switch for actuating the second push switch by application of the second pushing operation force on the push button, a guide for guiding a movement of the driving body along the axis of rotation of the knob, and a clicker for allowing the first and second push switches to cause a click feeling when the first and second push switches are actuated.

* * * * *

UNITED STATES PATENT AND TRADEMARK OFFICE

CERTIFICATE OF CORRECTION

PATENT NO. : 6,525,277 B2
DATED : February 25, 2003
INVENTOR(S) : Oba et al.

It is certified that error appears in the above-identified patent and that said Letters Patent is hereby corrected as shown below:

Column 7,
Line 60, change "beprovided" to -- be provided --

Signed and Sealed this

Thirtieth Day of September, 2003

JAMES E. ROGAN
*Director of the United States Patent and Trademark Office*